US010180214B2

(12) United States Patent
Schwartz

(10) Patent No.: US 10,180,214 B2
(45) Date of Patent: Jan. 15, 2019

(54) ADJUSTABLE SIZE LED FIXTURE

(71) Applicant: Abraham Schwartz, Monsey, NY (US)

(72) Inventor: Abraham Schwartz, Monsey, NY (US)

( * ) Notice: Subject to any disclaimer, the term of this patent is extended or adjusted under 35 U.S.C. 154(b) by 0 days.

(21) Appl. No.: 15/709,865

(22) Filed: Sep. 20, 2017

(65) Prior Publication Data

US 2018/0163930 A1 Jun. 14, 2018

Related U.S. Application Data

(63) Continuation-in-part of application No. 15/482,799, filed on Apr. 9, 2017.

(60) Provisional application No. 62/329,651, filed on Apr. 29, 2016.

(51) Int. Cl.

| | |
|---|---|
| ***F21K 9/275*** | (2016.01) |
| ***F21K 9/272*** | (2016.01) |
| ***F21V 21/14*** | (2006.01) |
| ***F21V 15/01*** | (2006.01) |
| *F21Y 103/10* | (2016.01) |
| *F21Y 115/10* | (2016.01) |
| *F21S 8/04* | (2006.01) |
| *F21Y 113/00* | (2016.01) |

(52) U.S. Cl.

CPC ..... *F21K 9/275* (2016.08); *F21K 9/272* (2016.08); *F21V 15/012* (2013.01); *F21V 21/14* (2013.01); *F21S 8/04* (2013.01); *F21Y 2103/10* (2016.08); *F21Y 2113/00* (2013.01); *F21Y 2115/10* (2016.08)

(58) Field of Classification Search

CPC ..... F21K 9/272; F21K 9/275; F21V 15/012; F21V 21/14

USPC ..... 362/225

See application file for complete search history.

(56) References Cited

U.S. PATENT DOCUMENTS

| | | | | |
|---|---|---|---|---|
| 7,441,922 | B2 * | 10/2008 | Huang | F21K 9/65 362/225 |
| 7,946,729 | B2 * | 5/2011 | Ivey | F21V 7/043 362/227 |
| 7,976,196 | B2 * | 7/2011 | Ivey | F21K 9/27 362/218 |
| 2006/0126325 | A1 * | 6/2006 | Lefebvre | F21V 21/30 362/217.05 |
| 2007/0242466 | A1 * | 10/2007 | Wu | F21V 19/008 362/362 |
| 2009/0122543 | A1 * | 5/2009 | Kuo | F21V 14/02 362/240 |

(Continued)

*Primary Examiner* — Bryon T Gyllstrom

(74) *Attorney, Agent, or Firm* — Israel Nissenbaum; Yitzy Nissenbaum

(57) ABSTRACT

An adjustable LED lighting fixture which accommodates LED lights of varying lengths. The LED fixture has a central body element, and two movable end elements movably attached to two opposing sides of the central body element and extend in a direction normal to a length of the fixture. The two end elements face each other with LED pin sockets facing each other whereby an LED tube light is able to be operationally inserted into the LED pin sockets. Two slidable elements are attached to the end elements and extending in a direction in a direction along the length of the fixture and toward the other of the end elements and through a retention element. The slidable elements permit the expansion and contraction of the length of the LED fixture, by sliding relative movement toward and away from the other of the end elements, to hold LED light tubes of varying lengths.

10 Claims, 4 Drawing Sheets

(56) References Cited

U.S. PATENT DOCUMENTS

| | | | | |
|---|---|---|---|---|
| 2010/0321921 | A1* | 12/2010 | Ivey | F21K 9/64 362/84 |
| 2011/0235319 | A1* | 9/2011 | Fukano | F21V 23/06 362/217.14 |
| 2013/0003380 | A1* | 1/2013 | Cao | F21S 8/031 362/249.07 |
| 2013/0077296 | A1* | 3/2013 | Goeckel | F21V 7/00 362/217.07 |
| 2014/0043800 | A1* | 2/2014 | Weber | F21S 6/004 362/190 |
| 2016/0178169 | A1* | 6/2016 | Keser | F21V 19/00 362/217.14 |

* cited by examiner

ADJUSTABLE SIZE LED FIXTURE

FIELD OF THE INVENTION

This invention relates to LED light fixtures, particularly of the elongated fluorescent tube replacement type and particularly to LED light fixtures of variable length

BACKGROUND

LED lighting has been replacing prior art fluorescent and incandescent lighting as well as CFL lighting because of its considerably lower power requirement, lower heat generation and concomitant extended life. Though initial costs are considerably higher, these costs are being lowered and the extended life and reduced number of replacement and more convenient use more than make up for the increased initial cost. The most common of the LED lighting is in the form of fluorescent like tubes with end pin attachments which, unlike fluorescent tubes, are identically configured for the common two foot, three foot and four foot lengths. Current LED fixtures can only accommodate a single length LED tube often in multiply arrays. If, for aesthetic, or other considerations, use of different sizes is called for, the entire fixture needs to be replaced.

SUMMARY OF THE INVENTION

It is an object of the invention to provide a single fixture for multiple LED tube lighting which is adjustable to accommodate LED tube lighting of different lengths, while maintaining an aesthetic appearance.

Generally the present invention comprises an LED lighting fixture configured to be adjustable to accommodate LED tube lights of varying lengths with a changeable length thereof. The LED fixture comprises a central body element, and two movable end elements configured to be movably attached to two opposing sides of the central body element. Each of the end elements extends in a direction normal to a length of the fixture with the two end elements facing each other and has has at least one LED pin socket positioned to directly face a pin socket of the other of the end elements whereby an LED tube light is able to have its respective end pins operationally inserted into the respective LED pin sockets of the end elements Two slidable elements are attached to one of the two end elements respectively, with each of the slidable elements extending in a direction at a right angle relative to the end elements and in a direction along the length of the fixture and toward the other of the end elements and through a retention element. The respective slidable elements are configured to permit the expansion and contraction of the length of the LED fixture, by sliding relative movement toward and away from the other of the end elements, to thereby accommodate LED light tubes of varying lengths but with the same diameters and end pin configurations. The retention element is configured to maintain trued sliding of the slidable elements as necessary to properly fit and maintain inserted LED light tubes into the electrical pin sockets of the end elements.

The LED lighting fixture is configured to be adjustable to accommodate LED tube lights of varying lengths. The LED lighting fixture comprises a central body element, configured to be affixed to or anchored to a substrate such as a ceiling, and two end elements, movably attached to the central body element with each of the end elements having at least one LED pin socket positioned to directly face a pin socket of the other of the end elements whereby an LED tube light is able to have its respective end pins operationally inserted into the respective LED pin sockets of the end elements. The end elements each comprise an LED socket containing member configured to extend in a direction normal to the length of the fixture with a slidable element, attached to the LED socket containing member, in a direction at a right angle relative to the LED socket containing member and extending in a direction toward the LED socket containing member of the other of the end elements and through a retention element which may be contained in or on the central body element. The slidable elements permit the expansion and contraction of the length of the LED fixture to accommodate LED light tubes of varying lengths but with the same diameters and end pin configurations, with the retention element maintaining trued right angled relationships necessary to properly fit and maintain inserted LED light tubes into the electrical pin sockets of the end elements.

Alternatively, the retention element is only supported by the slidable elements themselves The retention element maintains the respective slidable elements in close slidable juxtaposition relative to each other and may include a spring biasing element to maintain alignment between the respective slidable tubes. In another alternative, at least one of the slidable elements is tubular with a lengthwise hollow sufficiently enlarged and sized to snugly maintain slidable engagement of the other of the slidable elements therein. In one embodiment, the slidable elements are both tubes or tubular with square or rectangular configuration to facilitate relative sliding and to provide a passage for electrical wiring from ballasts in the LED fixture and to permit folding and unfolding of such wiring in the tubular elements with respective contraction and expansion of the LED fixture length. The tubular elements should have structural strength and rigidity to maintain relative positions and are preferably of metal such as steel though this requires insulation of the electrical elements and wiring.

At least one of the retention elements or the respective tube elements comprises detents or similar position fixing elements such that the respective tubular elements click into or assume a fixed position when the distance between the respective LED pin sockets is at a desired LED tube length such as 2, 3, and 4 foot lengths of currently available LED light tubes. The detents or positions fixing elements are releasable to permit variation of the distance between the end elements and opposing LED pin sockets.

As described, extending hollows in the tubular elements permit extended insertion therein of electrical components such as electrical wiring to the pin sockets and ballasts (as necessary) with the wiring being free to extend or fold to accommodate fixture length. Ballasts may alternatively be fixed within the central body element and the wiring accessing the ballast through open ends of the tube elements.

To accommodate 2, 3 and 4 foot LED light tubes, the tubular elements should not be less than about 23 inches in length (or a length supplemented by other structural elements) so that when fully extended there is the requisite maxim four foot length between the LED pin sockets (with the thickness of the end elements providing the additional length to achieve the forty eight or four foot lengths for pin engagement of the four foot LED light tubes. Tubular element lengths should not exceed two feet which would otherwise impede contraction to accommodate two foot long LED light tubes.

The above object, features and advantages of the invention will become more evident from the following discussion and drawings in which:

SHORT DESCRIPTION OF THE DRAWINGS

DETAILED DESCRIPTION OF THE INVENTION AND DRAWINGS

Figure 1:
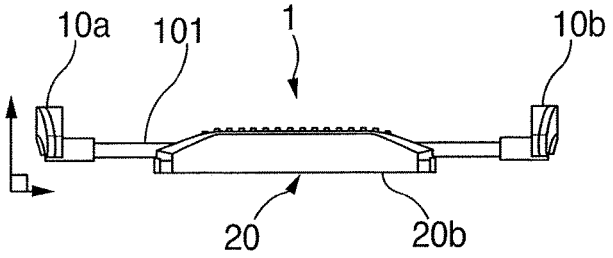
FIG. 1 is a side view of the adjustable LED fixture.
Figure 6:
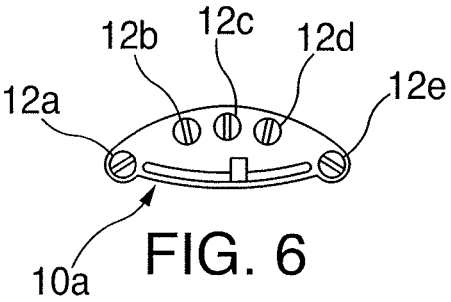
FIG. 6 is an inside end view taken along line 6-6 of FIG. 2.
Figure 7:
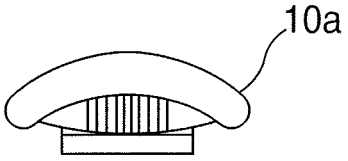
FIG. 7 is an outside end view taken along line 7-7 of FIG. 2.
Figure 8:
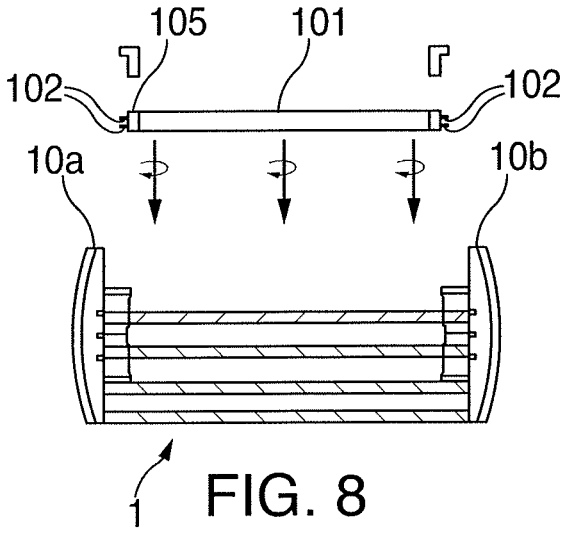
FIG. 8 illustrates the insertion of one LED light tube into the LED fixture of FIG. 1.
Figure 9:
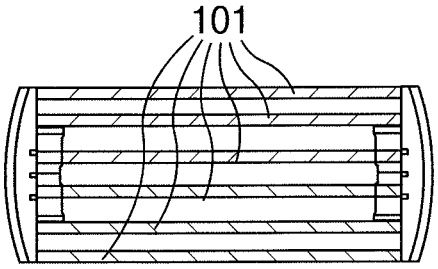
FIG. 9 shows a full array of five installed LED light tubes in the LED fixture of FIG. 1.

With reference to the drawings, LED fixture 1 in FIG. 1 has substantially identical LED socket end members 10*a* and 10*b* (commonly made of an insulating material) extending in a direction normal to base central body element 20. As seen in FIG. 6, each of the end members 10*a* and 10*b* (with 10*a* representing both) has five spaced apart LED pin sockets 12*a-e* into which the end pins 102 of LED light tubes 101 are configured to be operationally inserted (see FIG. 8). FIG. 9 shows an embodiment with six inserted LED light tubes 101.

The LED pin sockets 12*a-e* of the respective end member 10*a* and 10*b* directly face each other and end pins 102 and 100*b* of a single LED light tube 101 are operationally inserted into directly facing LED pin sockets of the end members 10*a* and 10*b*. The LED light tubes 101 are substantially identical in diameter and in end pin structure and placement and differ only in length (the LED light tube 101 being one of two feet in length, three feet in length and four feet in length).

Figure 3:
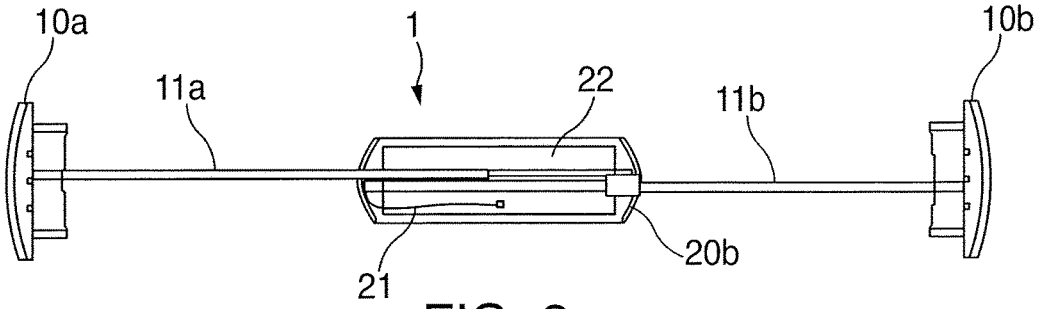
FIG. 3 is the top view of the LED fixture of FIG. 2, with the decorative cover removed and expanded into a full length configuration.
Figure 4:
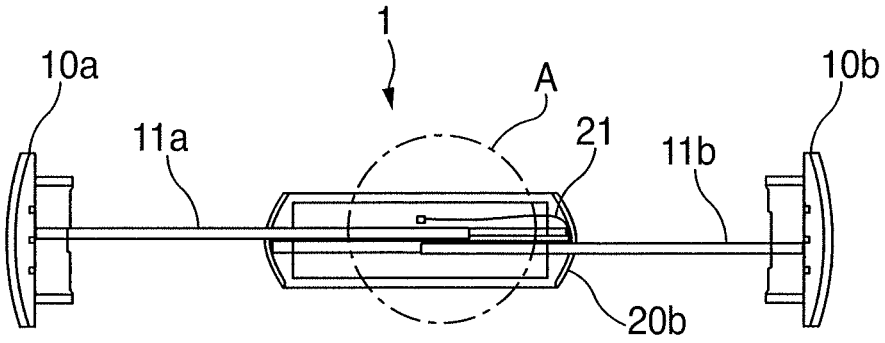
FIG. 4 is a top view of the LED fixture of FIG. 3, reduced to an intermediate length position.

As shown in FIGS. 3, 4 and each of the end members 10*a* and 10*b* has a tube or tubular element (11*a* and 11*b*) respectively extending directly toward the opposite end member in the plane of the base central body element 20. To facilitate sliding and direct contact, the tubes are rectangular. As seen, the respective tubes are positioned adjacent to each other in a slidable configuration relative to each other within base central body element 20 and are contained within a tubular guide 22 and biased therein with leaf spring 21 (shown in different but equivalent positions in FIG. 3 and FIGS. 4 and 5). To ensure trued sliding, one of the tubes may be of double width to contain both tubes therein with one being fixed and the other being slidable relative thereto.

Figure 5:
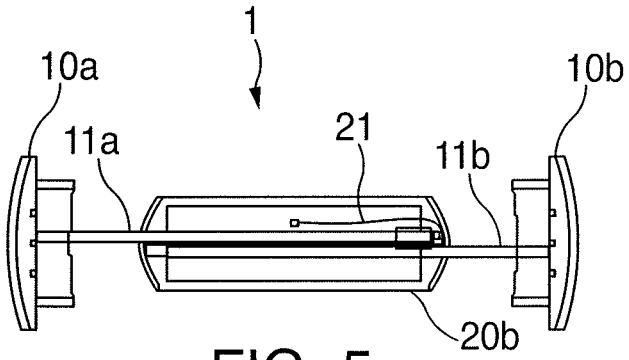
FIG. 5 is a top view of the LED fixture of FIG. 4 further reduced to its smallest length.
Figure 11:
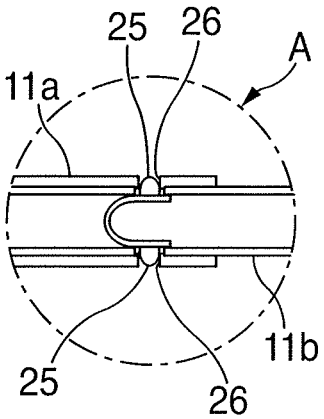
FIG. 11 is an expanded view of section A of FIG. 4 showing a spring biasing structure.

Central body element 20 is configured to be attached to a substrate such as a ceiling and is sufficiently below the pin sockets 12*a-e* such that multiple LED light tubes 101 can be seated in an arced configuration as in FIG. 9. Central body element 20 is further configured, as seen in expanded view in FIG. 11, with releasable spring loaded pins 25, or the like to snap into place on depressions 26 in the tube elements to indicate correct position for the four, three or two foot LED light tube accommodation varying lengths of the fixture 1, as shown in FIGS. 3, 4, and 5 respectively.

Figure 2:
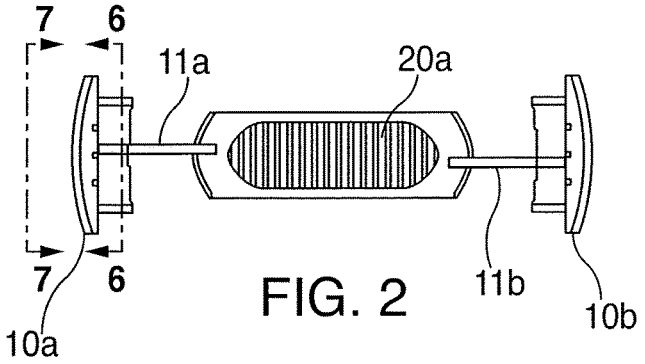
FIG. 2 is a top view of the LED fixture of FIG. 1 showing the fixture in its smallest length with a decorative cover over the central body.
Figure 10:
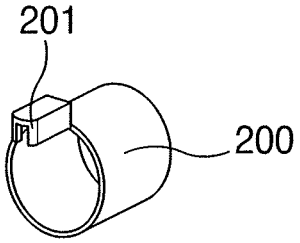
FIG. 10 is a perspective view of decorative cap for an LED light tube inserted into the LED fixture of FIG. 1.

Aesthetic elements are provided to the LED fixture 1, such as the exterior of end member 10*a* in FIG. 10, and the body element cover 20*a* in FIG. 2, which covers the sliding tubes on a base bottom 20*b*. Another aesthetic element which also serves to anchor elements in place are light tube end caps 200, shown in FIG. 10, which fit over the metallic ends 105 of socket-inserted LED light tubes 101 with protrusion 201 sized and rotatably positioned to snugly fit into recesses in end member 10*a* and 10*b*.

Figure 12:
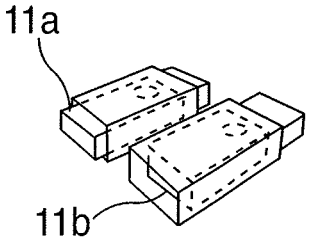
FIG. 12 is a perspective view of portions of the tubular sliding elements.

FIG. 12 shows the rectangular configurations of tube elements 11*a* and 11*b* respectively.

It is understood that the above description and Figures are merely exemplary of the invention with changes in structure and components may be possible without departing from the scope of the invention as defined in the following claims.

What is claimed is:

1. An LED lighting fixture configured to be adjustable to accommodate LED tube lights of varying lengths comprising a central body element, configured to be attached to two movable end elements on two sides thereof, with each of the end elements having at least one LED pin socket containing member positioned to directly face a pin socket of the other of the end elements whereby an LED tube light is able to have its respective end pins operationally inserted into the respective LED pin sockets of the end elements, wherein each of the end elements comprises an LED socket containing member extending in a direction normal to a length of the fixture, with two slidable elements, attached to the two end elements respectively, with each of the slidable elements extending in a direction at a right angle relative to the LED socket containing member and extending in a direction along the length of the fixture toward the LED socket containing member of the other of the end elements and through a retention element, wherein the respective slidable elements permit the expansion and contraction of the length of the LED fixture, by sliding relative movement toward and away from the other of the end elements to thereby accommodate LED light tubes of varying lengths but with the same diameters and end pin configurations, with the retention element maintaining trued right angled movement of the slidable elements as necessary to properly fit and maintain inserted LED light tubes into the electrical pin sockets of the end elements.

2. The LED lighting fixture of claim 1, wherein the central body element is configured to be attached to a substrate.

3. The LED lighting fixture of claim 2, wherein the respective LED pin socket containing members both comprise either 5 sockets each or 6 sockets each to accommodate either 5 or 6 LED tube lights.

4. The LED lighting fixture of claim 1, wherein the slidable elements each comprises a tube member with rectangular or square cross section.

5. The LED lighting fixture of claim 1 wherein the lighting fixture comprises releasable stops for relative movement of the slidable elements at positions of two, three and four feet between opposing LED pin sockets of the facing end elements and LED pin socket containing members.

6. The LED lighting fixture of claim 1, wherein the retention member comprises a spring biasing member to facilitate the maintaining of the trued right angled movement of the slidable elements.

7. The LED lighting fixture of claim 4 wherein electrical wiring of the LED lighting fixture is contained and routed within at least one of the tube members.

8. The LED lighting fixture of claim 1 wherein the retention member is attached to the central body element.

9. The LED lighting fixture of claim 4, wherein one the tube members is sufficiently larger in cross section than the other of the tube members wherein a smaller tube member is configured to snugly slidably fit within a larger of the tube members to function as the retention member.

10. The LED lighting fixture of claim 5, wherein neither of the slideable elements is more than two feet in length.

* * * * *